US005454695A

United States Patent [19]

Shah et al.

[11] Patent Number: 5,454,695

[45] Date of Patent: Oct. 3, 1995

[54] HIGH OUTPUT ENGINE COOLING FAN

[75] Inventors: Hemant S. Shah, Livonia; Joseph L. Terry, Dearborn; James A. Acre, Pinckney, all of Mich.

[73] Assignee: Ford Motor Company, Dearborn, Mich.

[21] Appl. No.: 270,550

[22] Filed: Jul. 5, 1994

[51] Int. Cl.[6] ..... F04D 29/38

[52] U.S. Cl. ..... 416/203; 416/169 A; 416/175; 416/189; 416/223 R; 416/238; 416/243

[58] Field of Search ..... 416/169 A, 175, 416/189, 192, 203, 223 R, 238, 243, DIG. 2, DIG. 5; 415/77, 78; 123/41.49, 41.65, 41.66

[56] References Cited

U.S. PATENT DOCUMENTS

| | | | |
|---|---|---|---|
| 1,462,151 | 7/1923 | Seymour . | |
| 2,468,723 | 4/1949 | Bartlett, Jr. | 416/243 |
| 3,169,694 | 2/1965 | Borchers | 416/223 R |
| 3,364,860 | 1/1968 | Schmitt-Matzen . | |
| 3,635,589 | 1/1972 | Kristiansen | 415/77 |
| 3,819,294 | 6/1974 | Honnold et al. . | |
| 4,088,352 | 5/1978 | Kling . | |
| 4,358,245 | 11/1982 | Gray | 416/189 |
| 4,770,002 | 9/1988 | Viegas et al. . | |
| 5,279,503 | 1/1994 | Propst | 416/169 A |
| 5,342,173 | 8/1994 | Vera | 416/169 A |

FOREIGN PATENT DOCUMENTS

| | | | |
|---|---|---|---|
| 0516440 | 9/1955 | Canada | 416/243 |
| 1428272 | 1/1969 | Germany | 416/243 |
| 1902598 | 2/1971 | Germany . | |
| 216176 | 11/1971 | U.S.S.R. . | |
| 0429958 | 6/1935 | United Kingdom | 416/175 |
| 2178798 | 2/1987 | United Kingdom | 416/169 A |

*Primary Examiner*—Edward K. Look
*Assistant Examiner*—Christopher Verdier
*Attorney, Agent, or Firm*—Roger L. May; Raymond L. Coppiellie

[57] ABSTRACT

A high output fan assembly for cooling the radiator of a motor vehicle. The fan assembly comprises a shaft, first and second fans, and a motor. The first fan includes a plurality of first blades, each of which has an inner portion attached to the shaft, while an outer hub is attached to an outer portion of at least one of the first blades. The second fan includes a plurality of second blades, each of which has an inner portion attached to the outer hub. The motor is drivingly connected to the shaft to drive the first and second fans at the same number of revolutions per minute. The fan assembly is situated either for pulling or for pushing air across the radiator and an air conditioning condenser of the motor vehicle.

10 Claims, 2 Drawing Sheets

HIGH OUTPUT ENGINE COOLING FAN

BACKGROUND OF THE INVENTION

1. Field of the Invention

This invention relates to fan assemblies for motor vehicles and, more particularly, to a high output engine cooling fan assembly for a motor vehicle having an inner set of blades and an outer set of blades connected to each other and to a common hub.

2. Description of the Prior Art

The internal combustion engine of a motor vehicle is normally cooled by fluid circulated through a jacket surrounding the engine. The fluid, in turn, is cooled by circulation through a radiator which is exposed to the ambient air. When the vehicle is in motion, "ram air" is forced over the radiator by the forward movement of the vehicle. Because the engine may also operate when the vehicle is not in motion, however, some provision must be made to circulate air over the radiator during this time.

Thus, motor vehicles are typically equipped with an engine cooling fan. Conventional engine cooling fans operate at one or more discrete speeds, and have a single set of fixed blades which all have identical shapes and thicknesses. Any given fan construction, however, operates at maximum efficiency only at one particular vehicle speed. At other vehicle speeds, the fan limits the volume of air that could theoretically pass over the radiator. Furthermore, conventional automotive engine cooling fans have hub-to-tip ratios ranging from 0.4 to 0.7 because any smaller ratios may result in recirculation of air, which decreases the efficiency of the system. Given a maximum feasible tip diameter dictated by space constraints, therefore, the hub must generally have at least a certain minimum diameter.

SUMMARY OF THE INVENTION

The present invention is a high output fan assembly for a motor vehicle. The high output fan assembly comprises a shaft, first and second fans, and a motor. The first fan includes a plurality of first blades, each of which has an inner portion attached to the shaft, while an outer hub is attached to an outer portion of at least one of the first blades. The second fan includes a plurality of second blades, each of which has an inner portion attached to the outer hub. The motor is drivingly connected to the shaft to drive the first and second fans at the same number of revolutions per minute.

Accordingly, it is an object of the present invention to provide a fan assembly of the type described above which has a greater efficiency than a conventional motor vehicle engine cooling fan.

Another object of the present invention is to provide a fan assembly of the type described above which has an inner set of blades and an outer set of blades connected to each other and to a common hub.

These and other objects, features, and advantages of the present invention are readily apparent from the following detailed description of the best mode for carrying out the invention when taken in conjunction with the accompanying drawings.

DESCRIPTION OF THE PREFERRED EMBODIMENTS

Figure 1:
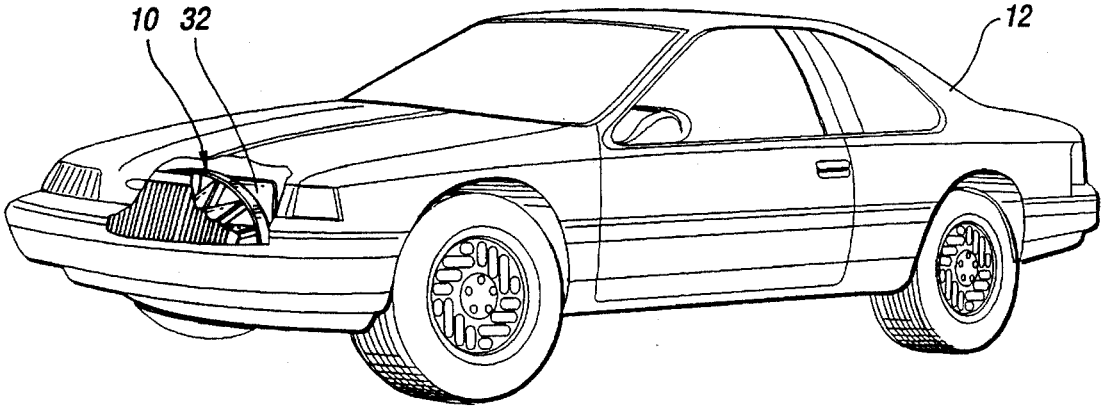
FIG. 1 is a perspective view of a motor vehicle including a high output fan assembly according to the present invention mounted forwardly of a radiator.
Figure 2:
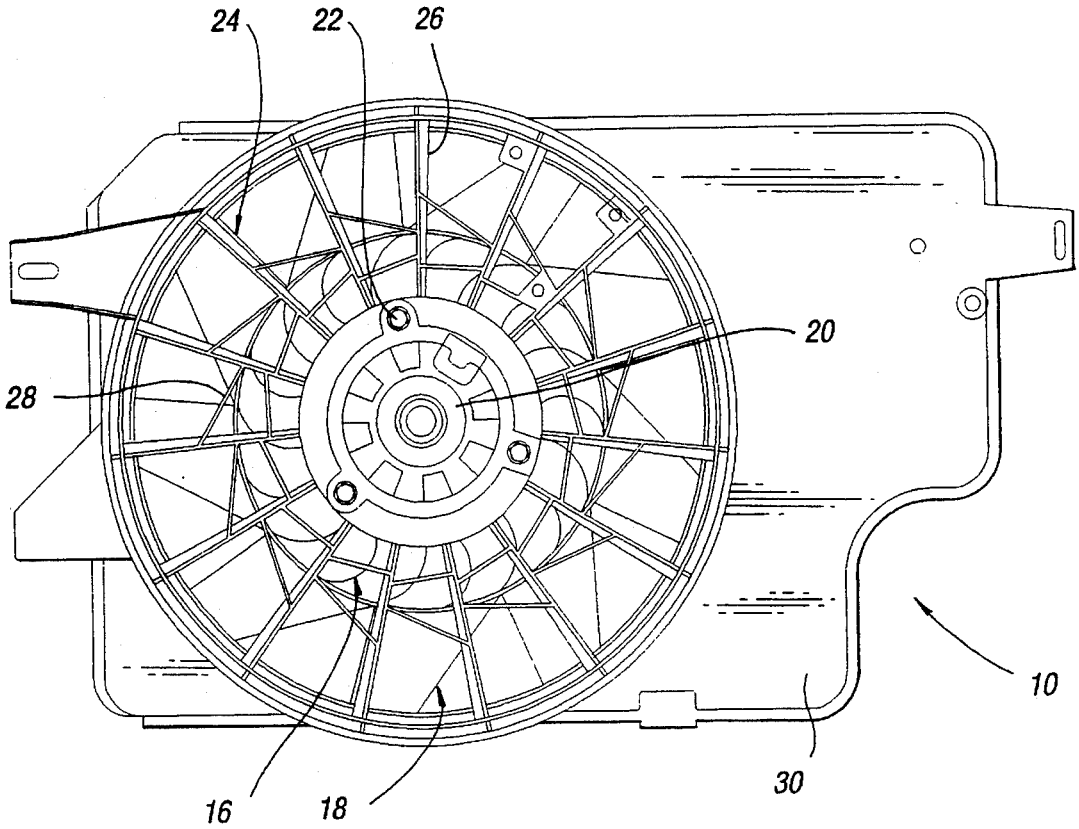
FIG. 2 is a front view of the fan assembly including a shroud, inner and outer fans, and a motor.
Figure 3:
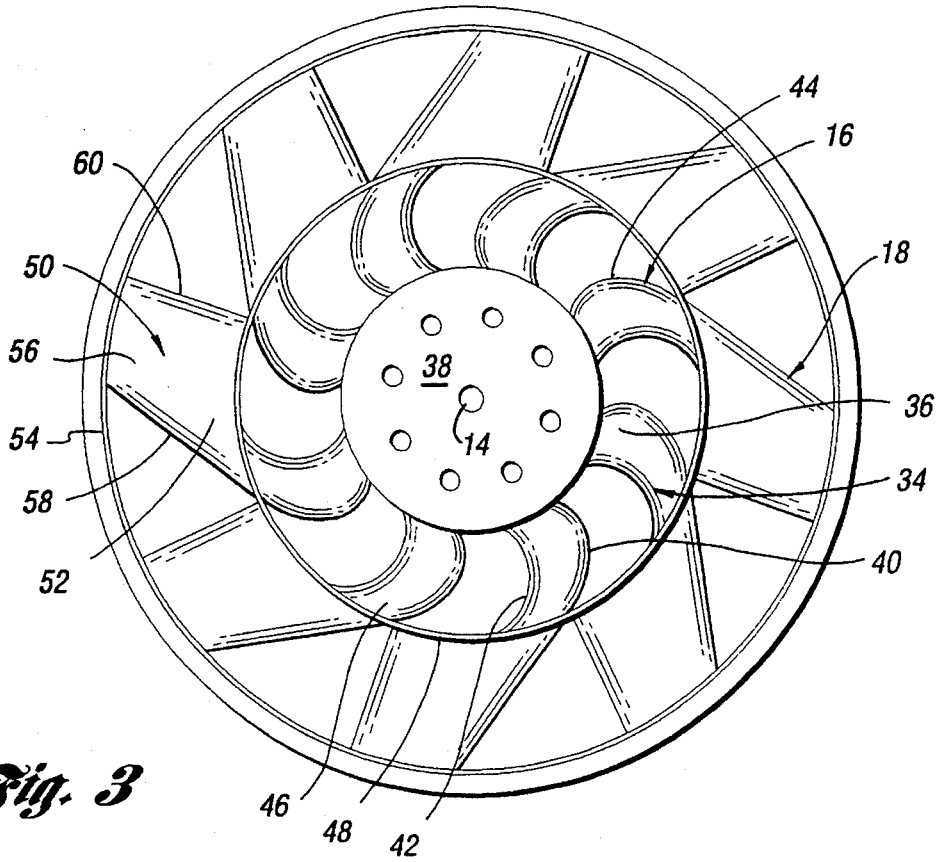
FIG. 3 is a front view of the inner and outer fans shown in FIG. 2.

With reference to the drawings, the preferred embodiments of the present invention will be described. FIGS. 1 through 3 show a high output fan assembly 10 according to the present invention for use in a motor vehicle 12. The fan assembly 10 comprises a shaft 14, a first or inner fan 16, a second or outer fan 18 and an electric motor 20. The motor 20 is mounted by bolts 22 to a screen 24, which is connected through a radial stator assembly 26 having connecting cross-members 28 to a preferably plastic housing or shroud 30. The shroud 30 in turn is disposed proximate a radiator 32 of the motor vehicle 12.

The inner fan 16 includes a plurality of first blades 34 with an average thickness of about six percent of the chord length of the first blades. Each of the first blades 34 has an inner portion or hub section 36 connected to a plastic inner hub 38, which is attached to the shaft 14. Advantageously, the inner hub has a diameter of between about four and five inches. Both a rounded leading edge 40 and a sharper trailing edge 42 of each of the first blades 34 are generally curved, with a radius of curvature that decreases slightly with the distance from the inner hub 38. The first blades 34 thus have a swept back orientation to their counterclockwise direction of travel as shown in FIGS. 2 and 3. The profile width of the first blades 34, as best seen in FIG. 3, is greatest at a forwardmost point 44 slightly spaced from the inner hub 38.

An outer portion or tip 46 of each of the first blades 34 is attached to an outer, generally annular plastic molding ring or hub 48. The first blades 34 are arranged at an angle of incidence ranging between about forty-three degrees at the tip 46 to about fifty-nine degrees at their inner portion 36. It should be appreciated, of course, that the incidence flow angles may be varied according to the flow requirements. The outer hub 48 preferably has a diameter of between about nine and ten inches, giving a hub-to-tip ratio for the inner fan 16 of between about 0.4 and 0.56.

The outer fan 18 is generally concentric and coplanar with the inner fan 16, and includes a plurality of second blades 50. Each of the second blades 50 has an inner portion or hub section 52. attached to the outer hub 48. It should be appreciated that the inner and outer fans 16 and 18 can be molded separately and then fastened to the inner and outer hubs 38 and 48, for example by welding or with an epoxy, or can be molded together as a unitary piece with the inner and outer hubs.

The outer fan 18 also includes an outer ring 54 connected to an outer portion or tip section 56 of each of the second blades 50. The second blades 50 have an angle of incidence varying uniformly between about twenty-one degrees at the tip section 56 and thirty-four degrees at the hub section 52, and have an average thickness of about six percent of the chord length of the second blades. Advantageously, the outer fan 16 has a tip diameter of about sixteen inches, giving the outer fan 18 a hub-to-tip ratio of between about 0.56 and 0,625. The fan assembly 10 thus has an overall hub-to-tip ratio of between about 0.25 and 0.31.

The second blades 50 each have a rounded, substantially straight leading edge 58 and a sharper, substantially straight trailing edge 60. However, the leading and trailing edges 58 and 60 of each second blade 50 extend from the outer hub 48 at different angles to the tangential, such that the profile width of the second blades 50 decreases with the radial distance from the outer hub 48. The second blades 50, like the first blades 34, are also generally concave as viewed in FIG. 2 and convex with respect to the incoming air flow.

The motor 20 is drivingly connected to the shaft 14 to drive the first and second fans 16 and 18 at the same number of revolutions per minute (rpm). Typically, the motor 20 may be either single or double speed motor. In place of an electric motor, it should be appreciated that a pneumatic or a hydraulic motor can also be used. Particularly in the case of a hydraulic motor, the motor may operate at maximum speeds up to about 3500 rpm. The shroud 26 may be mounted forwardly of the radiator 32, as shown in FIG. 1, so that the fan assembly 10 pushes air across the radiator 32 and the air conditioning condenser (not shown). Alternatively, the shroud 26 may be mounted between the radiator and the vehicle engine block to pull air past the radiator and the air conditioning condenser.

Figure 4:
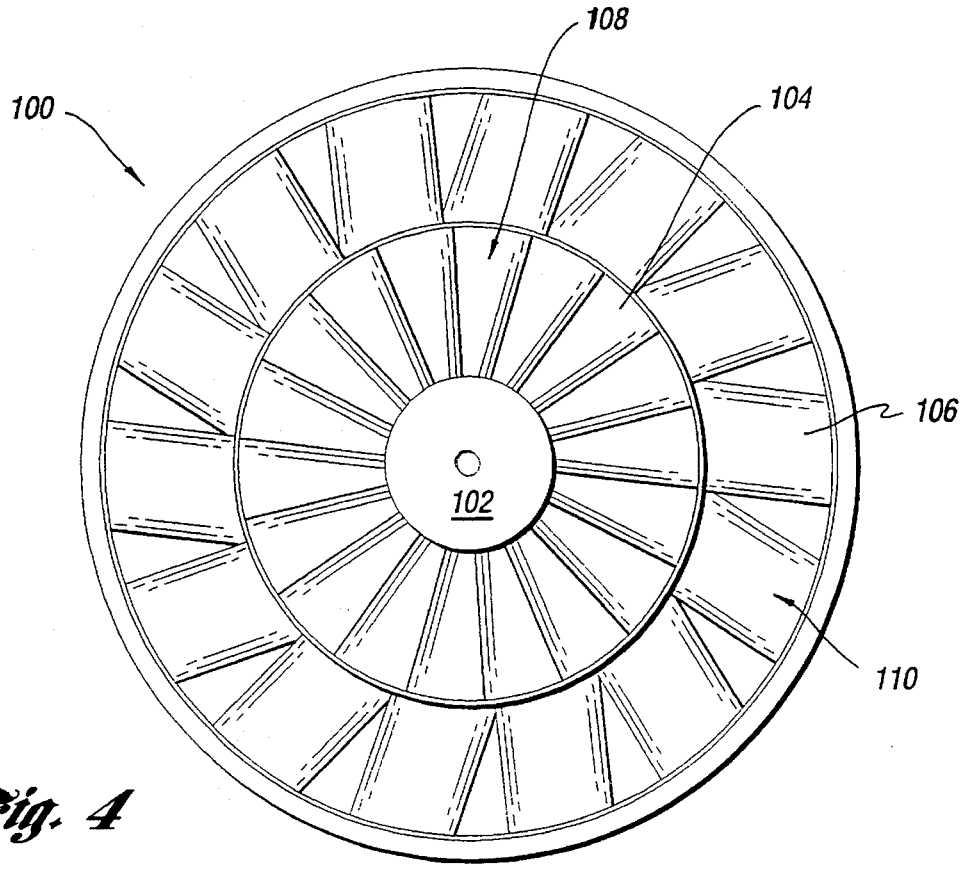
FIG. 4 is a front view of an alternative embodiment of the fan assembly.

FIG. 4 shows an alternative embodiment 100 of the fan assembly of the present invention having a smaller diameter inner hub 102. The fan assembly 100 has a greater number of inner blades 104 and a greater number of outer blades 106, as well as a greater overall cross-sectional area to the incoming air flow, than the embodiment 10. Both the leading and trailing edges of the inner blades 104 are substantially straight, and the leading edge of each inner blade overlaps the trailing edge of the adjacent inner blade. Similarly, the outer blades 106 overlap, although only at their inner ends and to a lesser extent than the inner blades 104. In the fan assembly 100, the inner fan 108 preferably has seventeen or eighteen blades, while the outer fan 110 has only thirteen or fourteen blades. It should be understood, of course, that the inner and outer fans of either embodiment can be provided with the same or a different number of blades.

The fan assembly of the present invention has a relatively high efficiency, i.e., it passes a relatively high volume of air for a given power input. Furthermore, the present invention is particularly effective across the range of ram air situations where, for a given cross sectional area in which the fan assembly must be mounted, a greater volume of air is allowed to pass. Another feature of the present invention is the provision of a relatively great amount of cooling air in the vicinity of the motor, which decreases the operating temperature of the winding, bearings and other components to prolong the life of the motor. Additionally, the fan assembly of the present invention can be packaged in a smaller space than conventional motor vehicle fans and still provide a given air flow.

It should be understood that while the forms of the invention herein shown and described constitute preferred embodiments of the invention, they are not intended to illustrate all possible forms thereof. It 10 should also be understood that the words used are words of description rather than limitation, and various changes may be made without departing from the spirit and scope of the invention disclosed.

We claim:

1. A fan assembly for a motor vehicle, comprising:

a shaft;

a first fan including a plurality of first blades, each of the first blades having an inner portion connected to the shaft and an outer portion, the first fan having a hub-to-tip ratio of between about 0.4 and 0.56;

an outer hub attached to the outer portion of at least one of the first blades;

a second fan including a plurality of second blades, each of the second blades having an inner portion attached to the outer hub, the second fan being generally coplanar with the first fan and having a hub-to-tip ratio of between about 0.5 and 0.625, the second fan having a blade profile different than a blade profile of the first fan; and a motor drivingly connected to the shaft to drive the first and second fans at the same number of revolutions per minute;

the fan assembly having an overall hub-to-tip ratio of less than about 0.4.

2. The fan assembly of claim 1 wherein the first blades have an angle of incidence between about forty-three degrees and fifty-nine degrees.

3. The fan assembly of claim 1 wherein the second blades have an angle of incidence between about twenty-one degrees and thirty-four degrees.

4. The fan assembly of claim 1 wherein the fan assembly has an overall hub-to-tip ratio of between about 0.25 and 0.31.

5. The fan assembly of claim 1 wherein the inner blades and the outer blades are molded together as a unitary piece.

6. The fan assembly of claim 1 wherein the fan assembly is situated in the motor vehicle in front of a radiator of the motor vehicle.

7. The fan assembly of claim 1 wherein the first and second fans have a different number of blades.

8. The fan assembly of claim 1 wherein the first fan has a greater number of blades than the second fan.

9. The fan assembly of claim 1 wherein each of the second blades has an outer portion attached to an outer ring.

10. The fan assembly of claim 1 wherein the motor comprises an electric motor.

* * * * *